US005595545A

United States Patent [19]

O'Brien

[11] Patent Number: 5,595,545

[45] Date of Patent: Jan. 21, 1997

[54] GOLF SWING TRAINING TRACK APPARATUS

[75] Inventor: Timothy M. O'Brien, Seatac, Wash.

[73] Assignee: Track Trainer, Inc., Seattle, Wash.

[21] Appl. No.: 538,435

[22] Filed: Oct. 3, 1995

[51] Int. Cl.[6] ..... A63B 69/36

[52] U.S. Cl. ..... 473/259

[58] Field of Search ..... 473/258, 259, 473/260

[56] References Cited

U.S. PATENT DOCUMENTS

| | | | |
|---|---|---|---|
| 1,399,761 | 12/1921 | Garland | 473/258 |
| 1,567,530 | 4/1924 | MacNaughton et al. | 473/259 |
| 2,653,025 | 9/1953 | Zega | 473/259 X |
| 3,339,927 | 9/1967 | Nunn | 473/258 |
| 3,711,103 | 1/1973 | Seltzer | 473/259 X |
| 3,795,399 | 3/1974 | Beckish | 473/259 X |
| 4,583,740 | 4/1986 | Ohly | 473/259 |
| 5,072,942 | 12/1991 | Hurley | 473/259 X |

*Primary Examiner*—George J. Marlo
*Attorney, Agent, or Firm*—Graybeal Jackson Haley

[57] ABSTRACT

A golf swing training apparatus having a circular track is made by bending an elongate X-section extrusion of an aluminum alloy to form a plurality of partial circular track sections, which are then joined end-to-end to form a full 360° circular hoop. A multi-wheeled club guide cart rides on the track with a V-shaped circumference of each wheel mated to radially inner and outer opposed corner edges of the track member. The golf club includes a shaft of uniform diameter that rotates and slides in a linear bearing that in turn is connected by a pivot to the cart that allows rotation of the linear bearing and pivoting of the bearing for free movement of the golf club shaft in a plane orthogonal to that of the hoop throughout the swing.

31 Claims, 11 Drawing Sheets

GOLF SWING TRAINING TRACK APPARATUS

BACKGROUND OF THE INVENTION

The invention pertains to improvements in a golf swing training apparatus of the circular track type for conditioning muscle memory and proper swing technique.

Various golf swing training devices have been proposed in which a circular or partial circular track guides the swing of a user's golf club in order to train the user in proper technique by simulating the feel and position of the back swing, power stroke, and followthrough. Examples of such known apparatus include U.S. Pat. Nos. 3,339,927; 1,399,761; 1,567,530; 4,583,740; 3,711,103; 3,795,399; and 5,072,942. An investigation by the present inventor has led him to discover a number of critical improvements in the construction and function of such circular track-type golf swing trainers, which are the subject of this invention and are summarized below.

SUMMARY OF THE INVENTION

In the golf swing training apparatus of the present invention, the circular track is made by constructing a circular hoop which, in the preferred embodiment, is formed by bending an elongate X cross-section stock material made of an extruded light weight metal such as an aluminum alloy to form a plurality of partial circular segments, preferably two semi-circular sections which are then joined end-to-end to form a full 360° circular hoop. The X-shaped extruded aluminum track member is bent along a diagonal leg (at 45°) so that the diagonally opposed corners of the bent track structure form radially inner and outer guide edge surfaces of the hoop track. Moreover, the unique X-shaped extruded section has a configuration of lengthwise extending voids and the corners appear in cross section as arrowhead-shaped extrusions that yield a superior strength-to-weight ratio and when uniquely connected together by flush clamping fasteners form a substantially rigid, rugged guide track. A multi-wheeled club guide cart having preferably a set of three spaced wheels journaled in bearings on a cart platform rides on the track with the V-shaped circumference of each wheel mated to the radially inner and outer opposed corner edges of the track member. The golf club includes a shaft of uniform diameter that rotates and slides in a linear bearing that in turn is connected by a pivot that allows rotation of the linear bearing and pivoting of the bearing for free movement of the golf club shaft in a plane orthogonal to that of the hoop throughout the swing.

Unique clamping brackets are mated to the X-shaped configuration of the extruded track section for joining the track hoop to a frame that includes telescopingly adjustable rear support struts and a front adjustable height ladder assembly which together enable the plane of the hoop to be both raised to the desired height of the user and tilted to different inclinations to fit the stance of the user. A coiled compression spring is coaxially mounted on the club shaft between a stop at the neck of the club head and acts between that stop and the linear bearing on the cart to cushion end-of-stroke impacts that would otherwise cause discomfort to the user.

In an alternative embodiment, the hoop and track are formed by combining a tubular track support frame with a molded polymer track material having radially inner and outer opposed grooves and secured in juxtaposition to a face of the tubular track by suitable circumferentially spaced fasteners. The polymer track itself has opposed track grooves that respectively face radially outwardly and radially inwardly of the hoop for receiving and guiding the set of cart wheels that in turn constrain the golf club to the proper swing plane.

DETAILED DESCRIPTION

Figure 1B:
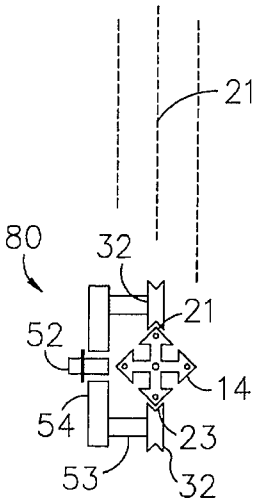
FIG. 1*b* is a fragmentary cross section of the track and guide cart of the apparatus of FIG. 1*a*.
Figure 1A:
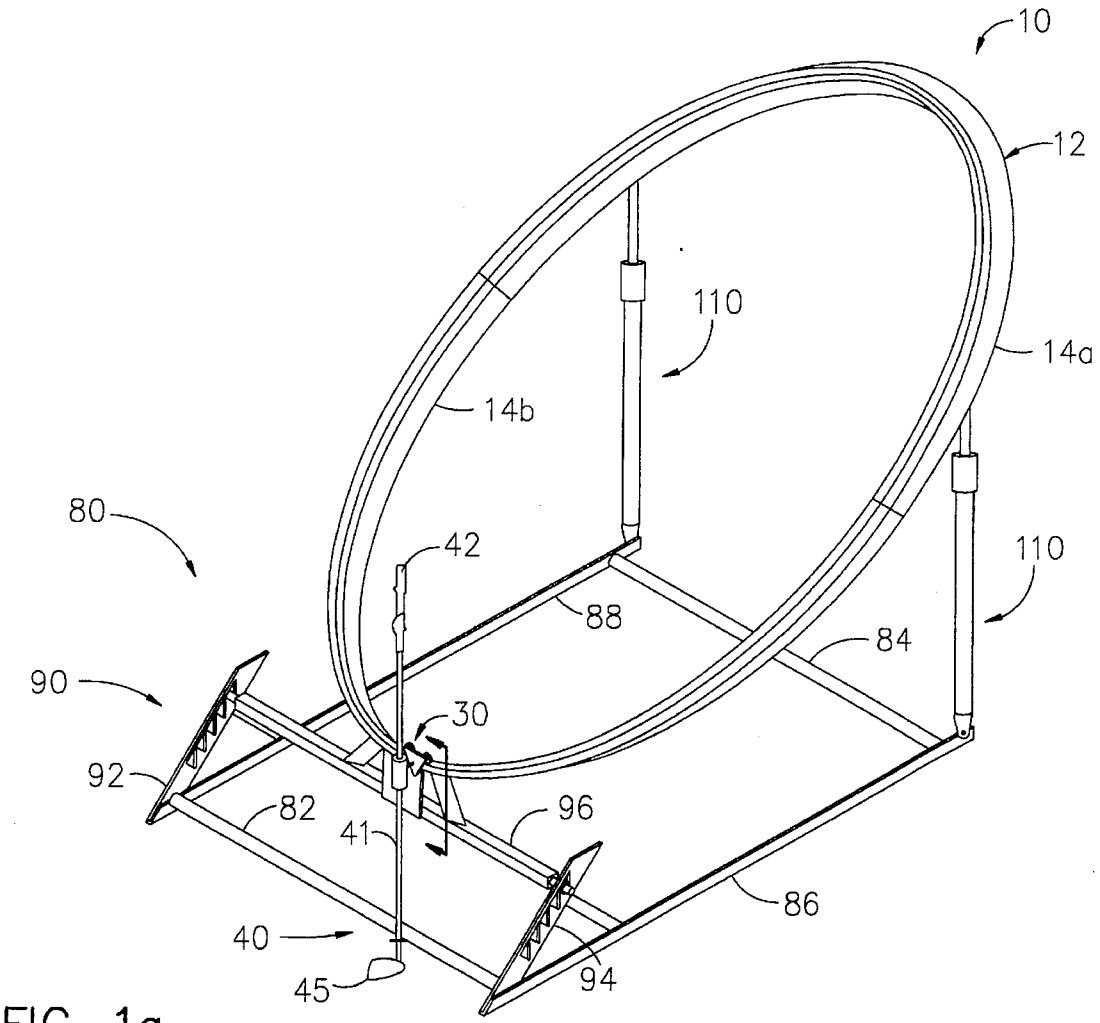
FIG. 1*a* is an isometric view of the preferred embodiment of the golf swing training apparatus according to the invention
Figure 2:
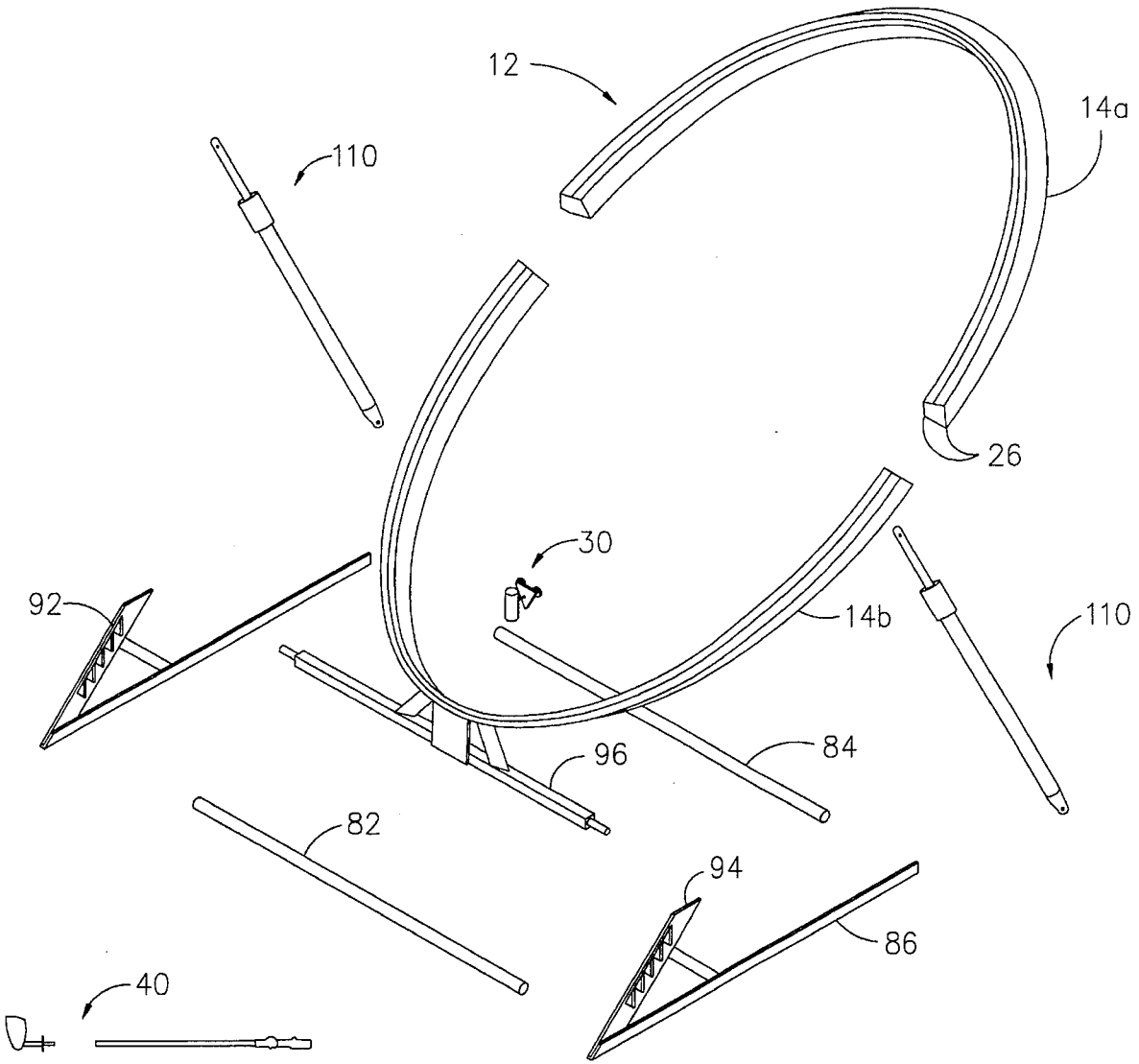
FIG. 2 is an assembly view of the main components of the apparatus of FIG. 1.

With reference to FIG. 1, a preferred embodiment of the golf swing training apparatus 10 has a circular hoop 12, the cross-section of which is specially configured to form a track 14 (see detail in FIG. 3) made of a plurality of semi-circular segments 14*a* and 14*b* (see FIG. 2). Each segment of track 14*a* and 14*b* is formed by starting with a straight extrusion, such as from a lightweight but strong, rigid material such as an aluminum, magnesium, or titanium alloy extruded through a die that produces an X-shaped section. At the center juncture of the crossing legs 18 lies a hollow box shaped core 16. The outer extents of the X-shaped legs 18 have extruded corners 20 that in cross-section appear as arrowhead-shaped and are blunted or rounded at the outer point or edge. The void regions between pairs of legs 18 and the undercut behind the arrowhead-shaped corners 20 result in a minimal weight yet high structural integrity member capable of providing the rigidity, strength and ruggedness for accommodating the acceleration forces of the golf swing when assembled into hoop 12. Additionally, the extrusion that provides track member 14 has a series of lengthwise extending voids or passageways including a centermost void 22 at core 16 and irregular cross-section voids 24 in the heads of each arrowhead-shaped corners 20 which further minimize the weight without loss of structural strength. As described below, these voids also serve as a convenient yet highly effective structure for accepting alignment dowels 26 that bridge the abutting ends of the track segments and hold them in near perfect alignment when hoop 12 is assembled.

A multi-wheeled cart assembly rides on hoop 12 and has a set of three grooved circumference wheels 32 journaled in bearings on the cart assembly for riding on diagonally opposed edges 21 and 23 formed by the arrowhead-shaped corners 20 of the extrusion. These track member edges 21 and 23 face radially inward and radially outward in the plane of the hoop 12 as illustrated in FIG. 1*b*. Thus the multi-wheeled cart assembly 30 is guided in a circular path that is maintained in or parallel to the same plane as hoop 12.

Figure 6:
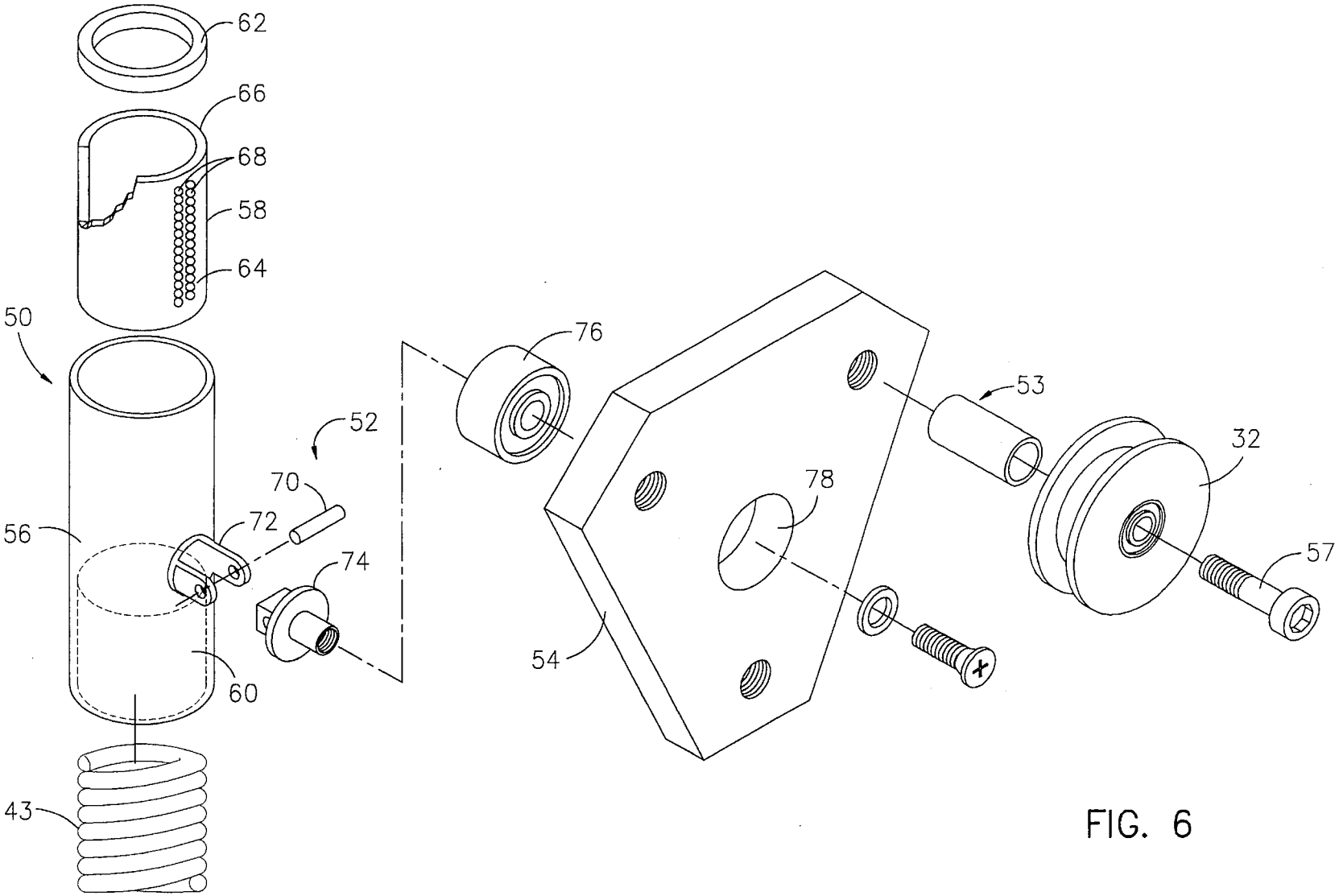
FIG. 6 is an exploded view of the cart assembly including a linear bearing that mounts the golf club shaft to the cart and a cushioning spring that acts between the linear bearing and a washer stop adjacent the club head.
Figure 7:
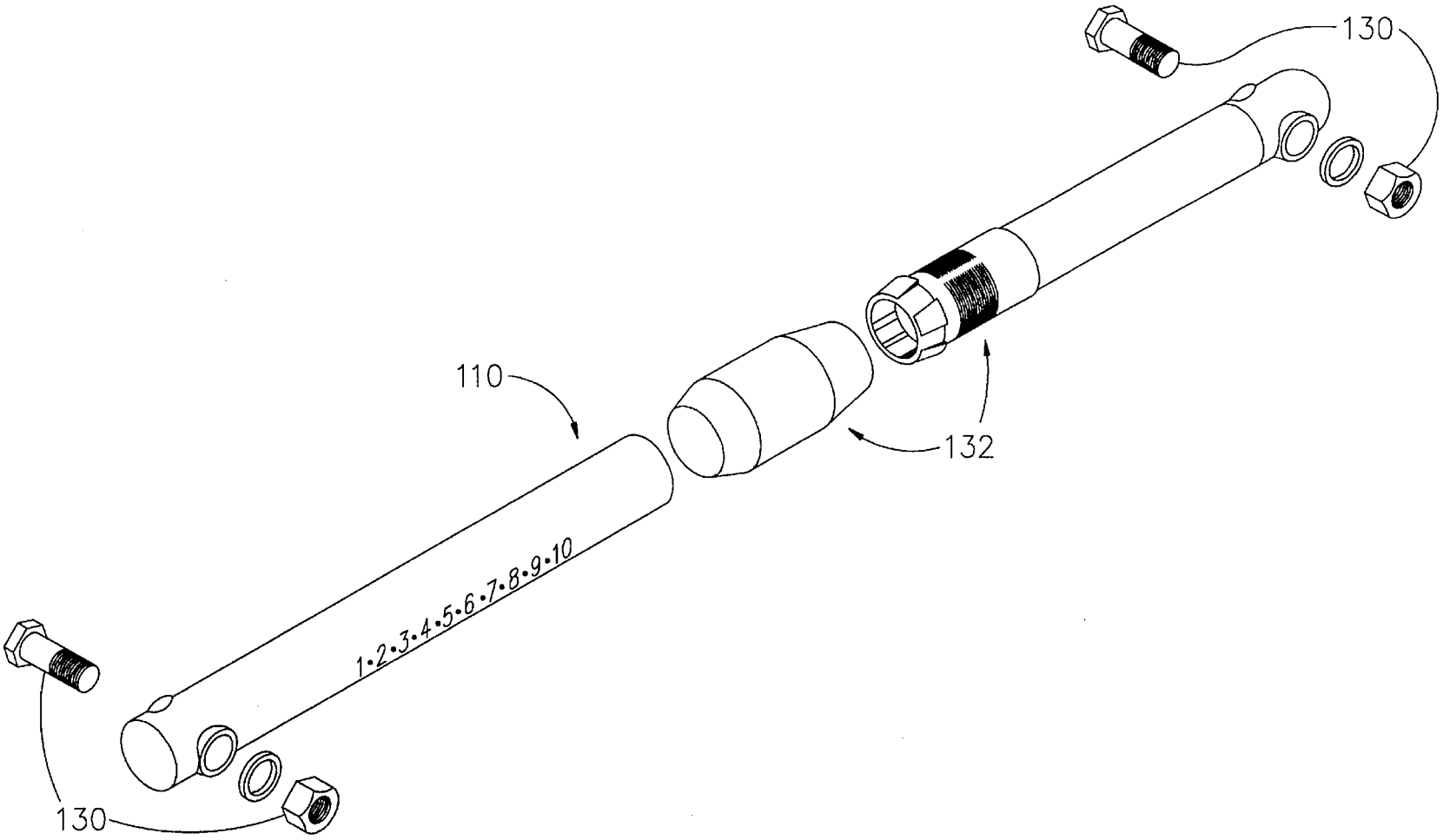
FIG. 7 is an exploded view of the telescopic adjustment of the rear struts that adjust the tilt of the hoop relative to the base frame.

A club-to-cart attachment 40 provides a positive connection between a training golf club 42 and the cart assembly 30 while allowing by various bearings and pivots a smooth non-binding dynamic action between the club and cart as the user swings club 32 from back swing to power stroke to followthrough. More particularly, the club-to-cart attachment 40 has the components as shown in FIG. 6 of a multiple element linear bearing assembly 50 and a rotatable and pivotal connection 52 between linear bearing assembly 50 and a platform 54 of the cart assembly to which wheels 32 are mounted by standoffs 53 and bolts 57. Bearing assembly 50 includes a tubular housing 56 in which a pair of axially spaced linear bearings 58 and 60 are coaxially retained by such means as an end seal 62 and a similar seal (not shown) at the opposite ends of housing 56. Each of linear bearings 58 and 60 contain multiple oblong recirculating ball bearing tracks 64 as shown for bearing 58 that are oriented lengthwise and radially of the housing 56 and of the individual bearing subhousing 66. Ball bearings 68 rotate in these oblong recirculating tracks with the inner ball bearing surfaces protruding inwardly so as to contact and cooperate with a uniform diameter (not tapered) club shaft 41 between handle and head 43 and 45, respectively. Linear bearings 58, especially as paired at axially spaced positions within tubular housing 56, provide an exceptionally smooth linear or sliding movement of the club shaft together with virtually no friction in the rotation of the shaft and club throughout the training swings.

As the club moves dynamically in its sliding and rotating action within tubular housing 56, a pivot 52 that is connected to the cart platform 54 has two degrees of articulation. First, there is a pivot fulcrum about a pin 70 joining yoke to a lug 74 forming an axis of rotation that is transverse to the axes of tubular housing 56 and linear bearings 58 and 60. Lug 74 of pivot 52 is in turn journaled for rotation in a bearing 76 press fit into a central bore hole 78 provided in platform 54 which allows lug 74 to rotate about an axis normal to platform 54 and orthogonal to the pivot axis provided by pin 70 in yoke 72. This in turn allows the yoke 72 and hence tubular bearing housing 56 to rotate about an axis normal to the cart platform 54 while yoke 72 and pivot pin 70 accommodate a "teeter-totter" pivot action of limited arcuate rotation that allows the training club 42 to pivot about a sliding point along its shaft in a plane that extends orthogonally to that of the hoop. This "teeter-totter" pivot action of bearing tube 56 and the club received therein corresponds to the change in the orientation of the club as the user's hands move away from or back towards the plane of hoop 12 during the full golf swing.

Figure 3:
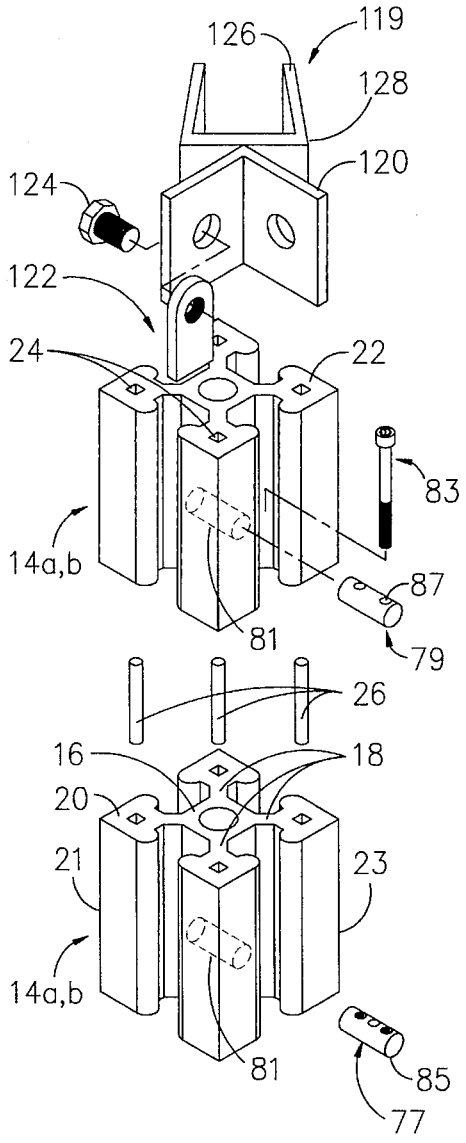
FIG. 3 is an exploded view of the end-to-end connection of the segments of track extrusion that are formed from X-cross- section aluminum extrusion.

The semicircular track segments 14*a* and 14*b* are joined and held together by unique flush clamping assemblies including slugs 77 and 79 and a pair of bolts 83 (one is shown in FIG. 3) that together with alignment dowels 26 result in a full 360° circular hoop that acts as a structural unit as though made from one piece. These clamping assemblies shown in FIG. 3 include at each joint a pair of transverse cylindrical slugs 77 and 79 fitted into cross track bores 81 that are on opposite sides of each track segment joint and such that the ends of the slugs are flush or recessed to the outer profile of the X-section track. One of each pair of slugs 88 and 79 has threaded holes 85 that are alignable with the length of the track and are positioned in the void space between the X-section legs 18. The other of the slug pair has similar holes 87 but unthreaded and larger to allow a pair of bolts 83 of the socket head type to pass through these holes and threadedly mate with holes in the paired slug, so that when assembled and tightened the bolts and slugs pull the end of the X-section track segments 14*a* and 14*b* together. The socket head of the bolts are accessible by a wench acting between legs 18 of the extrusion so that when assembled and tightened the joint is as strong as the continuous extrusion and the clamping assembly is flush with the track so as to not obstruct the cart travel.

Figure 4:
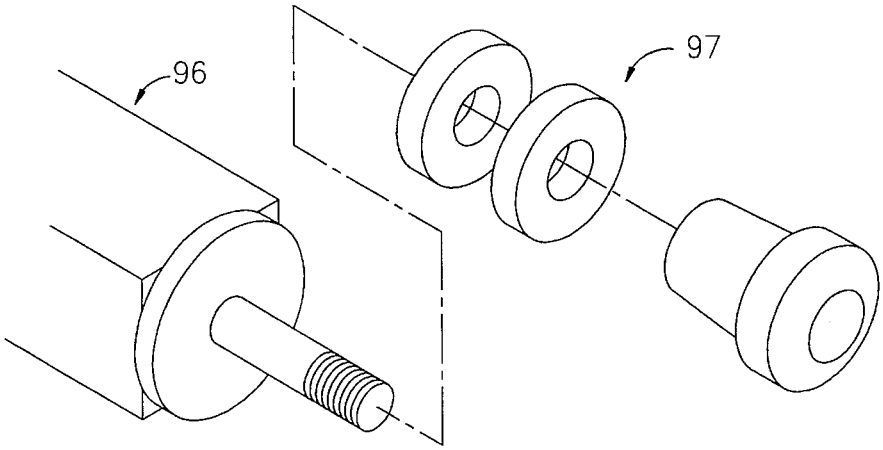
FIG. 4 is a fragmentary exploded view of the releasable fastener that joins a horizontal support bar to the adjustable ladder structure at the front of the apparatus of FIG. 1.

Hoop 12 and the sliding cart assembly 30 and club 42 are in turn supported on a base frame that elevates the entire hoop holding the lower front edge up off the ground and tilting the plane of the hoop upwardly and rearwardly as viewed from the front of the assembly as shown in FIG. 1*a*. The user thus stands inside the upstanding but tilted hoop as shown in the sequence of FIGS. 9*a*–9*e*. Base frame 80 includes an open rectangular frame base of front and rear horizontal members 82 and 84 and front to back side members 86 and 88. Near the front of this base 80 is an adustable height ladder assembly 90 including laterally spaced apart upwardly and rearwardly inclined notched holders 92 and 94 to adjust the height of a front horizontal elongate support member 96 held at its ends by threaded studs and by hand nuts and washer assemblies 97 (see FIG. 4) in holders 92 and 94 and supporting the lower front part of hoop 12 by a plurality of brackets 98 welded to horizontal bar 96 and fastened to the extruded aluminum track as follows. Each of brackets 98 has at its end opposite bar 96 a piece of structural angle stock welded to brackets 98 so that the 90° inside corner of each of angle pieces 100 mate with one of the non-guide corners of the track 14 extrusion. Specially formed flat lug nuts 102 slide into the void space between adjacent legs of the extrusion fitting behind the interior flanges formed by the arrowhead-shaped corners and have threaded openings that are accessible between the corners to receive attachment bolts and nuts 104 that clamp the angle pieces 100 to the track 14*b* as indicated. Angle pieces 100 are sized so that they do not extend so far as to interfere with the guide edge corners 21 and 22 formed in the plane of hoop 12 for receiving and guiding the V-shaped wheels of cart assembly 30.

To complete the support of hoop 12 on base frame 80, a pair of telescopically adjusting rear struts 110 connect the rearmost corners of base frame 80 to mid-height attachment brackets on hoop 12 as best shown in FIG. 1*a*. The attachments brackets are illustrated in FIG. 3 to have an angle piece 120, specially shaped lug nuts 122, and bolts 124 attaching angle piece 120 to the X-shaped extrusion of the track as described above in connection with the front base bar 96. Angle piece 120 and a similar angle piece for the other rear adjusting strut are fastened to an edge corner of the extruded track that is outside the guide plane of corners 21 and 23 so as to again not interfere with the movement of the cart wheels. The other part of strut attachment brackets 119 include a channel-shaped piece 126, the back connective portion of which is welded to the back of angle piece 120 as illustrated, and horizontally aligned pin or screw openings 128 are provided in channel 126 to receive bolt fastener assemblies 130 that also pass transversely through the upper end of adjustable strut 110. A similar transverse bolt assembly 130 is provided for joining the lower end of strut 110 to base frame 80. Each of struts 110 includes a manually releasable and lockable collar assembly 132 that has a released position that enables the lengthening or shortening of strut 110 and a locked position holding the length fixed in the desired inclination or tilt of hoop 12. Struts 110 may be independently adjusted to a certain extent so that the hoop 12 can be set slightly askew on base frame 80 as desired.

Figure 8:
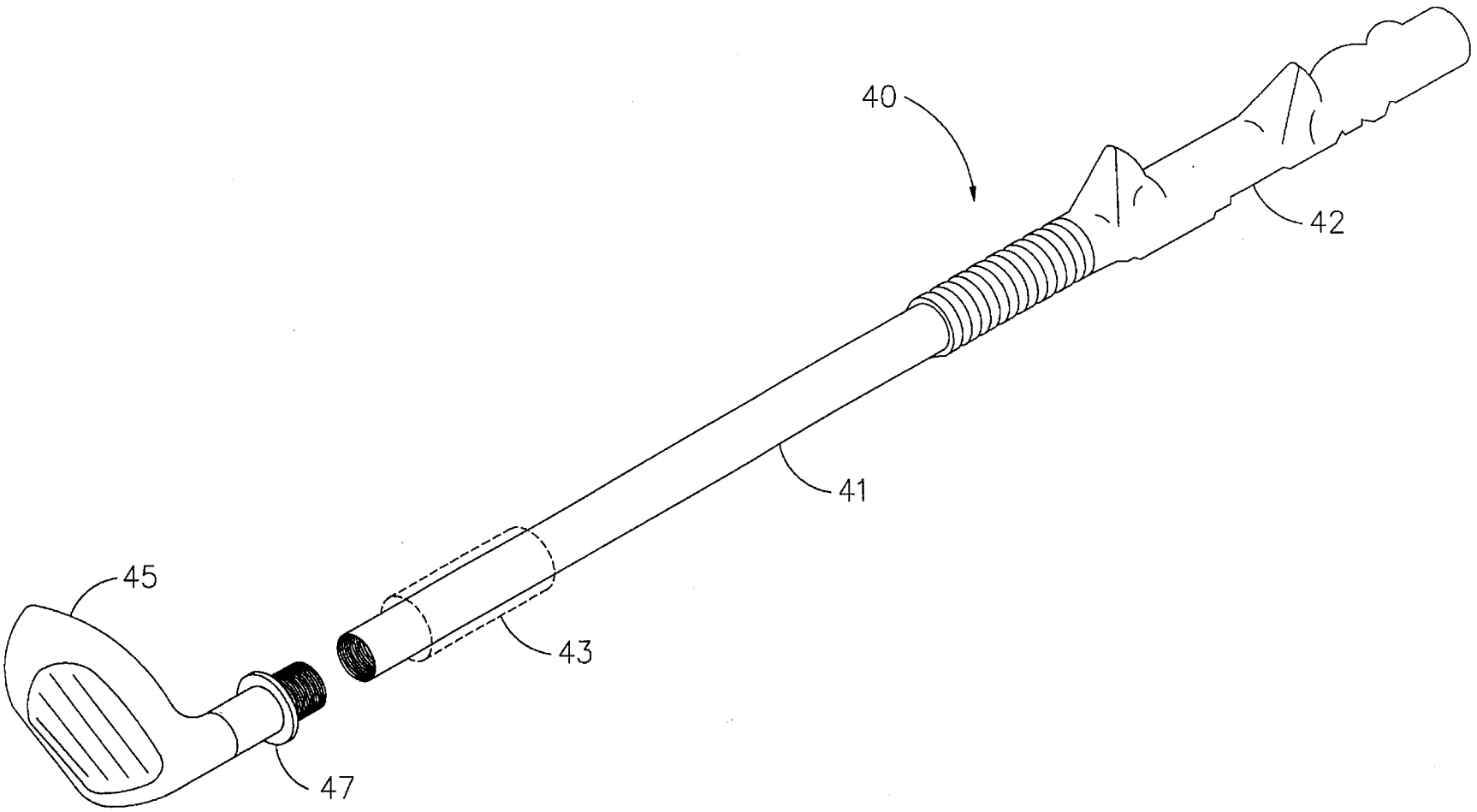
FIG. 8 is a partially exploded view of a left-handed style training golf club used in the embodiment of FIG. 1.

As shown in FIG. 6 and in FIG. 8, a coiled cushioning spring 43 is coaxially fitted on shaft 41 between bearing assembly 50 and a washer stop 47 at the neck of club head 45. The compression of spring 43 absorbs shock or jarring that would be felt by the user at the end of the back swing and followthrough. Club 40 may be left or right handed and head 45 is threaded onto shaft 41 by threads of a sense opposite the force moment that would loosen the head when impacting the ground.

Figure 9C:
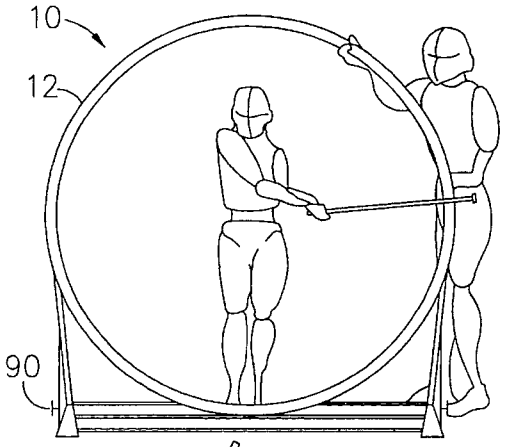
FIGS. 9*a*–9*e* show the use and adjustability of the height and inclination plane of the hoop for various users.
Figure 9B:
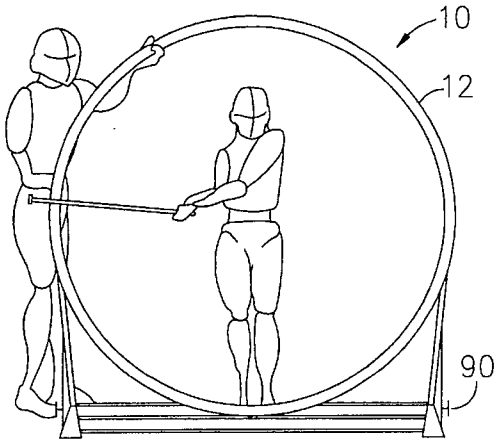
Figure 9A:
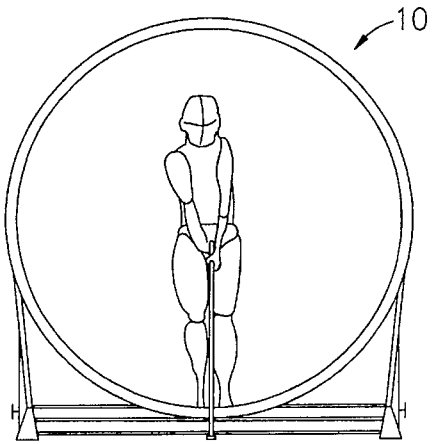
Figure 9E:
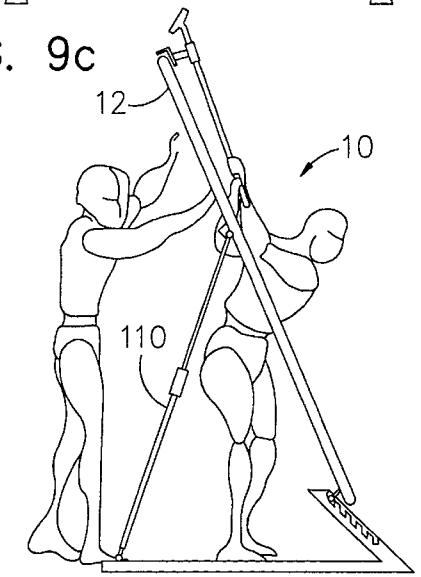
Figure 9D:
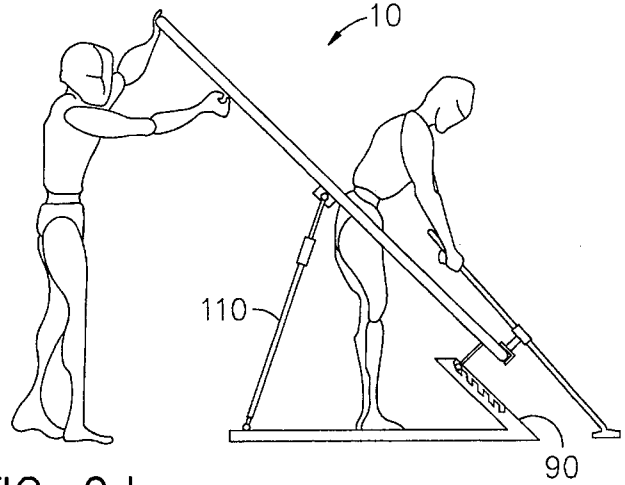

FIGS. 9*a*–9*e* illustrate the initial adjustment of the swing training apparatus 10 which is preferably done with an assistant while the user assumes a normal golf swing stance standing within the hoop and within the framework of base frame 80 slightly forward of the foreaft mid-point of the hoop as vertically projected to the ground or floor. In FIG. 9*a*, the user is in a stance of addressing the ball while in FIGS. 9*b* and 9*c*, the height of the apparatus is adjusted by using the adjustable front ladder assembly 90 to raise the height of hoop 12 to a position where the horizontal orientation of the club during the back swing and followthrough are about aligned with the mid-points of the hoop in the vertical plane. The inclination or tilt of apparatus 10 is then adjusted as shown in FIG. 9*d* and 9*e* by loosening and adjusting rear struts 110 to incline hoop 12 so that, as shown in FIG. 9*e*, the track forces the golf club to a position in which the club is aligned with the plane of the hoop while the player is in a proper back swing and followthrough stance. After these adjustments have been made, the apparatus is thereby set up for practice and muscle memory training by the user as the user swings from addressing the ball as shown in FIG. 9*a* to a full back swing shown in FIG. 9*e*, through the power stroke, the mid-point of which is indicated in FIG. 9*b*, and a followthrough, the mid-point of which is illustrated in FIG. 9*c*. The cart with its multiple degrees of low friction freedom of rotation, lengthwise sliding, and track guiding while maintaining a secure and positive connection between the club shaft and the circular hoop track forces the user to feel the proper movement of the legs, torso, arms and hands as the body moves the club in a fixed plane inclined to the ground which is the most technically optimum golf swing.

Figure 10:
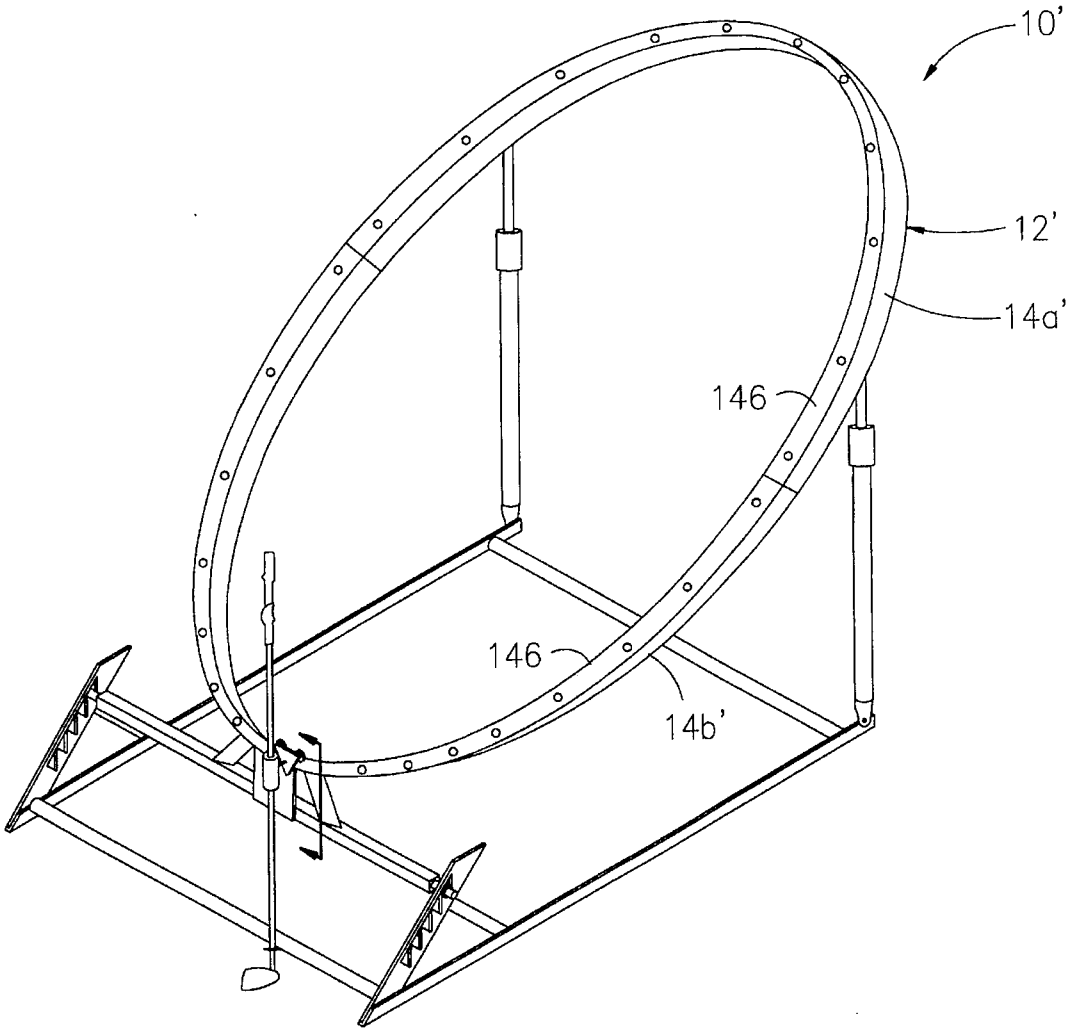
FIG. 10 is an isometric view similar to FIG. 1 showing an alternative embodiment of the invention in which the track is made from curved segments of opposed grooved polymer material that receives rounded circumference cart wheels.
Figure 12:
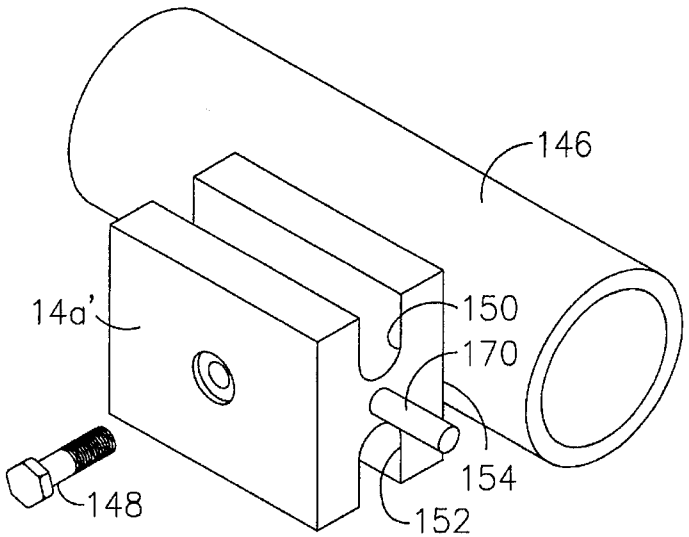
FIG. 12 is an enlarged fragmentary partially exploded view of the hoop assembly of the embodiment shown in FIG. 10 showing the opposed groove polymer track member fastened to a tubular track support frame which together form the guide hoop of the embodiment of FIG. 10.

An alternative embodiment of the golf swing training track apparatus is illustrated by apparatus 10' in FIG. 10 in which hoop 12' has a track cross-section formed by at least two sections of partial circular track segments 14*a*' and 14*b*' fastened to a multi-section tubular hoop support frame 146. Each of track segments 14*a*' and 14*b*' are made of a rectangular section polymer machined or molded nylon fabricated in curved sections. Here only two sections are shown although the circular track may be formed in as many as three to ten segments mated end-to-end and fastened to tubular frame 146 by circumferentially spaced screw fasteners 148 that pass through a solid mid-body portion of track segments 14*a*' and 14*b*' and into tubular frame 146 with each of segments 14*a*' and 14*b*' fastened to a front face as viewed in the front plane of the tubular member 146 so that grooves 150 and 152 are oriented in a plane parallel to that of the frame 146 and slightly forward of the front mounting face of frame 146. The side 154 of track segments 14*a*' and 14*b*' that contacts and is held to the confronting face of hoop frame 146 is preferably contoured on a semi-circular radius that mates to the exterior circumferential surface of the tubular frame 146 as best shown in FIG. 12. With this assembly, the opposed wheel receiving grooves 150 and 152 are oriented in a common plane spaced slightly forward and parallel to the plane of the hoop tubular frame 146 with the groove 150 facing radially inwardly and the groove 152 facing radially outwardly and smoothly aligned at the joints between track segments.

Figure 11:
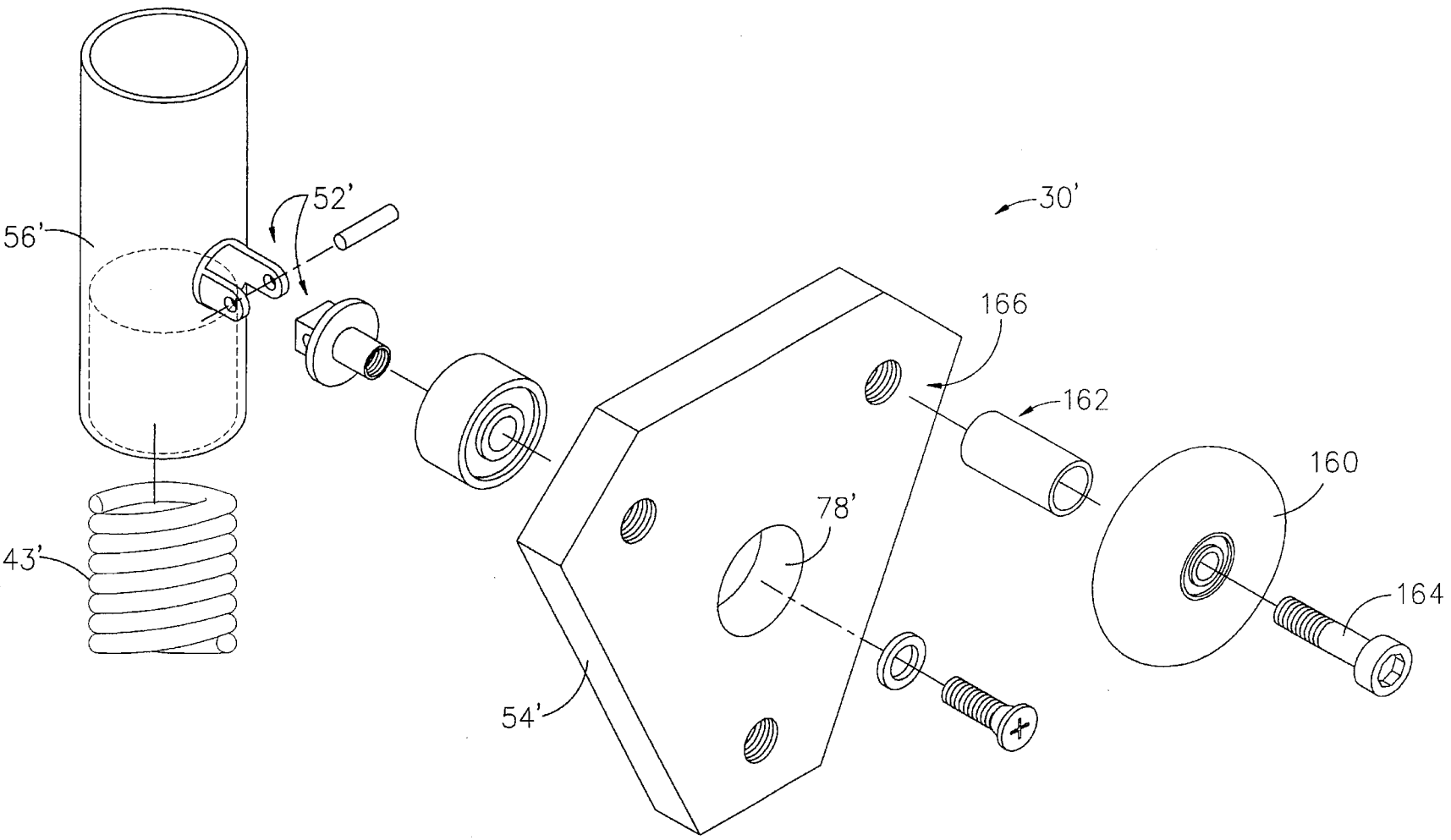
FIG. 11 is an exploded view of the multi-wheeled cart assembly of the alternative embodiment shown in FIG. 10 including the linear bearing and cushioning spring.

In FIG. 11, the multi-wheeled cart assembly 30' for the alternative embodiment of FIG. 10, has essentially the same bearing and pivot construction as illustrated in FIGS. 1–8 and described above. The cart platform 54' for the cart assembly 35 has a plurality of track engaging wheels, in this instance, a set of three wheels 160 are used (only one of which is shown) held to cart platform 54' by offsets 162 and bolts 164 engaging threaded openings 166 normal to platform 54' and spaced apart in a triangular array as illustrated. The exterior track engaging surface of wheels 160 have a rounded radius as viewed in cross-section (not shown) so as to conform to the rounded internal radius of grooves 150 and 152 of the track segments 14*a* and 14*b*, thereby allowing the cart free movement along the lengthwise axis of the tracks while constraining the cart to the desired plane parallel to that of hoop frame 146.

Figure 5:
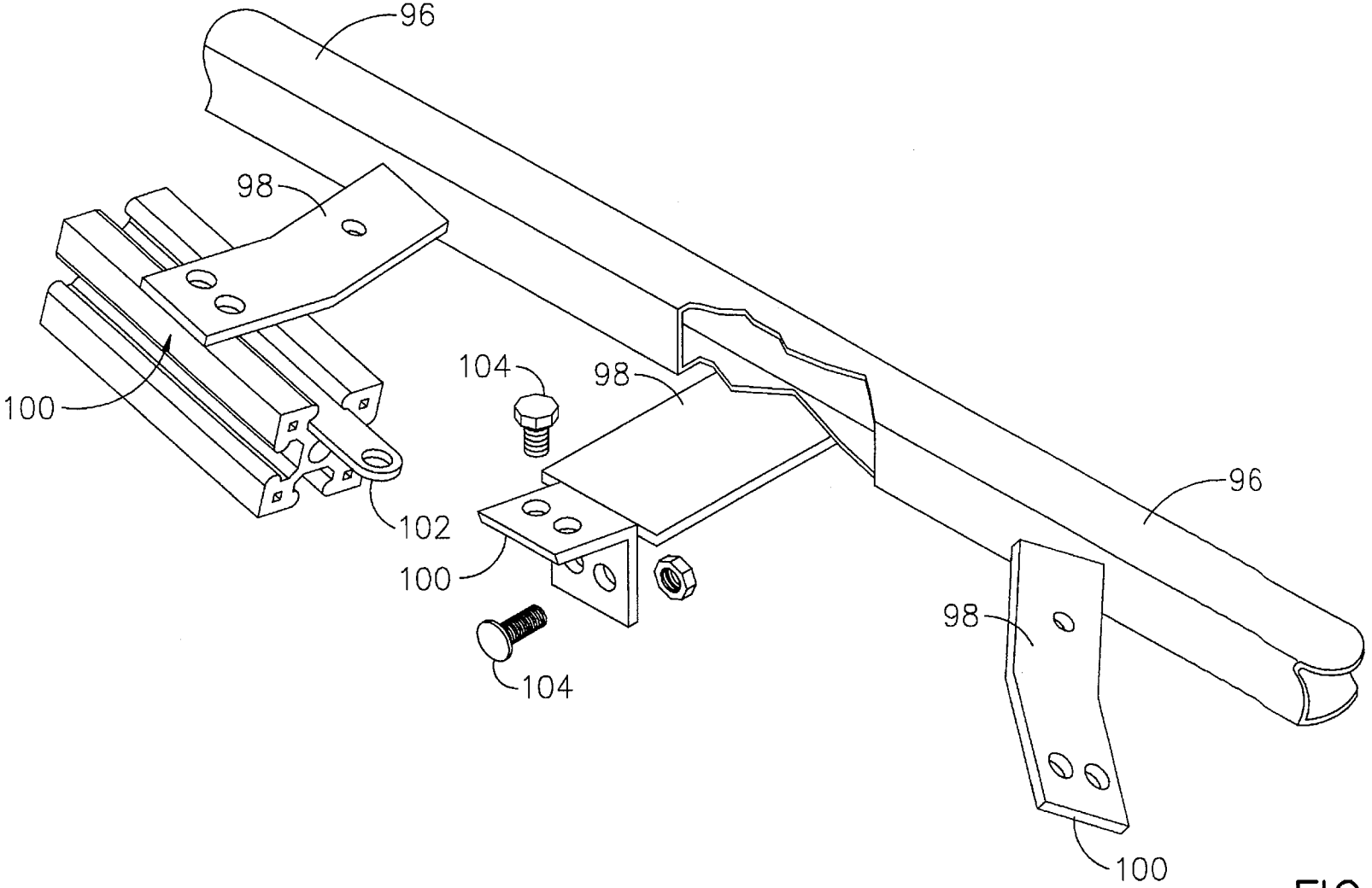
FIG. 5 is a fragmentary view, partly exploded, of the unique brackets and fasteners that join a front support bar to the extruded aluminum track in its circular hoop configuration as shown in FIG. 1.
Figure 13:
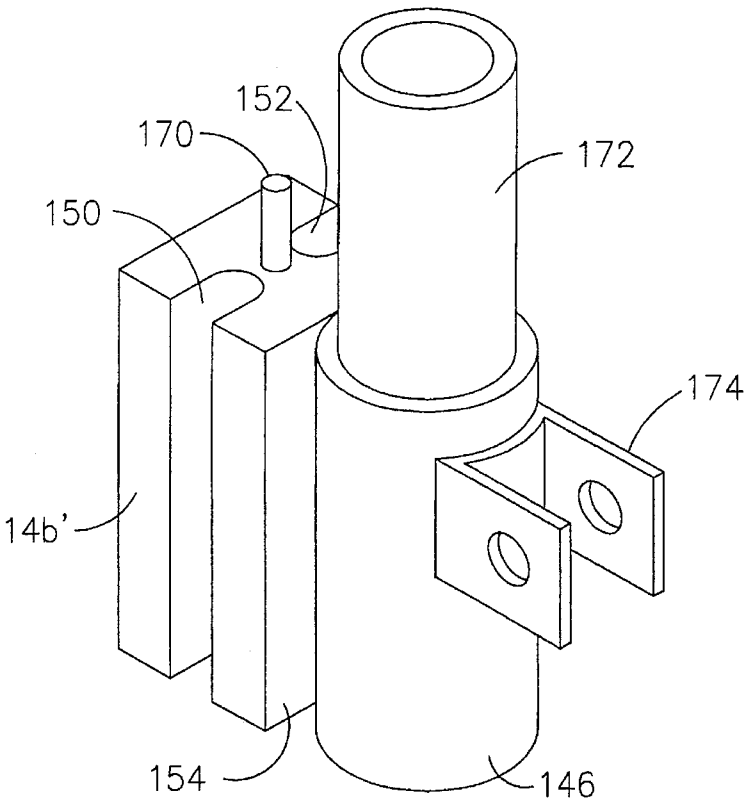
FIG. 13 is another view of a section of the polymer track and tubular support frame including a bracket on the tubular support frame for attachment to one of the rear tilt adjusting struts.

The various track segments 14*a*' and 14*b*' are preferably provided with dowels 170 as shown in FIG. 13, extending axially of the track body and threaded or friction fit into lengthwise bore holes formed in the track segments between grooves 150 and 152 in the solid mid-body of the polymer track segment. Similarly, each of the sections of tubular frame 146, two such semi-circular hoop sections are used in this embodiment, have undersized tubular pylons 172 at each joint of the tubular frame sections 146 coaxially press fit into the interior of each tubular frame 146 at their respective ends. Dowels 170 and pylons 172 ensure alignment of the various tubular frame and track sections, forcing the track grooves 150 and 152 into alignment at the end-to-end joints. To secure the hoop assembly, including tubular support 146 and track segments 14*a*' and 14*b*', rear strut brackets 174, such as shown in FIG. 13, and similar angle-shaped brackets corresponding to brackets 100 for the embodiment shown in FIG. 5 are welded to the tubular hoop frame at the same various circumferential locations shown for apparatus 10 in FIG. 1*a* and FIG. 2.

While only particular embodiments have been disclosed herein, it will be readily apparent to persons skilled in the art that numerous changes and modifications can be made thereto, including the use of equivalent means, devices, and method steps without departing from the spirit of the invention.

I claim:

1. A golf swing training apparatus of the circular track type for conditioning muscle memory in proper swing technique comprising the improvements of:

a circular hoop made of a plurality of elongate curved segments formed by bending a generally rectangular cross-section track member along a diagonal and joining the segments end-to-end to form diagonally opposed track member edges located on radially inner and outer surfaces of said hoop;

a multi-wheeled cart mounted to ride on said hoop and be guided by said hoop track member edges;

a golf club having a head and grippable handle at opposed ends of a club shaft;

a club-to-cart attachment having a rotatable and slidable bearing cooperating with said shaft intermediate said head and handle, and a pivot connecting said bearing to said cart so that said club rotates about its axis in said bearing, slides lengthwise along its axis in said bearing, and pivots at a moving point along said shaft in a plane orthogonal to that of said hoop; and a base mounting said hoop with its plane inclined upwardly, whereby a user stands inside said hoop and swings the club in a backswing, power stroke and followthrough guided by the cart riding on the hoop.

2. The golf swing training apparatus of claim 1, wherein said multi-wheeled cart comprises a plurality of wheels, at least one of which has an outer circumferential groove that engages an edge of said track member segments.

3. The golf swing training apparatus of claim 1, wherein said multi-wheeled cart comprises a cart body and at least first and second wheels journaled for rotation on said cart body at spaced-apart positions and having V-grooved circumferences that engage and are constrained in the plane of said hoop by said diagonally opposed track member edges of said hoop segments.

4. The golf swing training apparatus of claim 1, wherein said multi-wheeled cart comprises a cart body and a set of at least three wheels journaled for rotation on said cart body at spaced-apart locations, said wheels each having an exterior circumferential V-shaped groove, first and second of said wheels disposed so that their V-shaped exterior grooves engage a radially inner edge of said track member and a third said wheel engaging a radially outer edge of said track member so that said cart body is constrained to ride on said hoop parallel to the plane of the hoop without rotation relative to the curved axis of the track member.

5. The golf swing training apparatus of claim 1, wherein said track member comprises an extruded X-shaped section bent with one diagonal leg in the plane of the hoop and with the other diagonal leg at right angle to the plane of the hoop.

6. The golf swing training apparatus of claim 5, wherein said X-shaped section of said track member has extruded corners that in cross-section appear as arrowheads and which project outwardly from a central track core so that one diagonally opposed set of such arrowhead-shaped corners serves as the radially inner and outer guide edges of said track member and add edge strength and overall structural rigidity to the hoop.

7. The golf swing training apparatus of claim 6, wherein said edges formed by arrowhead-shaped corners have lengthwise extending void channels centered in each extrusion corner for enhancing the strength-to-weight ratio of the extruded hoop track member.

8. The golf swing training apparatus of claim 7, wherein said X-shaped section of said track member has at the centermost crossing of the legs a central void channel for enhancing the strength-to-weight ratio of the extruded hoop track member.

9. The golf swing training apparatus of claim 8, comprising recessed segment connectors including retainers extending transverse to the track member and threadedly cooperating with lengthwise-extending bolts that clamp the track member segments together so that the ends of each cross-shaped track member segment are held in registration for smooth running of the wheeled cart along the guide edges.

10. The golf swing training apparatus of claim 9, wherein said segment connectors further comprise a plurality of dowels disposed in at least certain of said lengthwise void channels of the extruded track member bridging each joint to enhance edge-to-edge alignment of the end-to-end assembled hoop track member segments.

11. The golf swing training apparatus of claim 10, wherein said retainers are cylindrical slugs fitted into transverse bores extending through the center track core of said extruded X-shaped section so that the ends of said slugs are disposed flush with the outer profile of said extruded X-shaped section and have at least one threaded bore hole having an axis aligned lengthwise of the track and inside said profile for receiving a bolt that is disposed lengthwise of the track within open space between adjacent legs of the X-shaped extrusion and is rotatable to clamp the ends of said segments together.

12. The golf swing training apparatus of claim 11, wherein a pair of said transverse cylindrical slugs are provided at each end-to-end joint of the track segments, one of said cylindrical slugs having threaded openings aligned to parallel the lengthwise axis of the track segments, another of said cylindrical slugs having pass-through bolt openings aligned with said threaded openings, and at least one clamping bolt slidably passing through the pass-through bore opening of one of the cylindrical slugs and threadedly engaging the aligned threaded opening of the other transverse cylindrical slug so that upon tightening of the bolt the cylindrical slugs cause a forced clamping of the ends of the track segments together in a secure guide edge-to-edge aligned joint.

13. The golf swing training apparatus of claim 1, wherein said club shaft has a slidably reciprocating portion of uniform diameter for slidable and rotatable cooperation with said bearing.

14. The golf swing training apparatus of claim 13, wherein said bearing of said club-to-cart attachment comprises an elongated linear bearing unit having a plurality of ball bearings that circulate in oblong retaining channels disposed lengthwise of said bearing unit to contact and minimize friction to both lengthwise sliding and axial rotation of the club shaft therewithin.

15. The golf swing training apparatus of claim 1, wherein said pivot of said club-to-cart attachment comprises first and second degrees of free rotation between said bearing and said multi-wheeled cart, a first degree of freedom being rotation of said bearing in a plane parallel to that of said hoop, and a second degree of freedom being pivotal movement of said bearing in a plane that passes generally through the diameter of said hoop and extends orthogonally to the plane of said hoop, whereby said club shaft is permitted to pivot in said orthogonal plane and rotate in a plane parallel to the hoop as the golf club swing is guided by the cart around the hoop circumference from backswing to power stroke and followthrough.

16. The golf swing training apparatus of claim 1, wherein said club-to-cart attachment further comprises an end-of-stroke cushioning spring mechanism disposed between said club head and said bearing for cushioning inertial impact between said bearing and club head during the backswing and followthrough portions of the training swing.

17. The golf swing training apparatus of claim 1, wherein said mounting frame comprises a base that is adapted to rest on a horizontal support surface and further comprising an adjustable front ladder assembly for adjusting the height of a lower front segment of said hoop and a plurality of rear telescoping struts extending between said base and said hoop for adjusting the incline of the plane of said hoop.

18. The golf swing training apparatus of claim 17, wherein said adjustable front ladder assembly comprises a horizontally disposed support bar having midlength structure connected to a lower forward segment of said hoop and having ends that extend laterally of said hoop being held in a plurality of vertically indexed height-adjusting notches formed in a frame structure that is supportedly connected to said base at laterally opposed front corners of said base.

19. The golf swing training apparatus of claim 17 wherein said track member comprises an extruded X-shaped section bent with one diagonal leg in the plane of the hoop and with the other diagonal leg at right angle to the plane of the hoop, and further comprising brackets for attaching said hoop to said mounting frame at least one of said brackets, including a nut sized and shaped to fit between adjacent legs of said extruded X-shaped section and bolt cooperating with said nut to clamp one of said brackets to said hoop.

20. A golf swing training apparatus of the circular track type for conditioning muscle memory in proper swing technique comprising the improvements of:

a circular hoop made of a plurality of elongate curved segments of generally rectangular cross-section track having opposed wheel receiving grooves formed in the plane of the hoop and joining the segments end-to-end to form opposed guide grooves located on radially inner and outer surfaces of said hoop;

a multi-wheeled cart mounted to ride on said hoop and be guided by said hoop track member grooves;

a golf club having a head and grippable handle at opposed ends of a club shaft;

a club-to-cart attachment having a rotatable and slidable bearing cooperating with said shaft intermediate said head and handle, and a pivot connecting said bearing to said cart so that said club rotates about its axis in said bearing, slides lengthwise along its axis in said bearing, and pivots at a moving point along said shaft in a plane orthogonal to that of said hoop; and a base mounting said hoop with its plane inclined upwardly, whereby a user stands inside said hoop and swings the club in a backswing, power stroke and followthrough guided by the cart riding on the hoop.

21. The golf swing training apparatus of claim 20, wherein said multi-wheeled cart comprises a plurality of wheels, at least one of which has an outer circumferential surface that nests inside one of said grooves of said track member segments.

22. The golf swing training apparatus of claim 20, wherein said multi-wheeled cart comprises a cart body and at least first and second wheels journaled for rotation on said cart body at spaced-apart positions and having circumferences that are fitted to said opposed track grooves and are constrained thereby to maintain said cart riding in a plane parallel to said hoop.

23. The golf swing training apparatus of claim 20, wherein said circular hoop further comprises a tubular track support frame and said plurality of elongate curved track segments are secured in juxtaposition to a face of said tubular track support frame by a plurality of fasterners spaced circumferentially around said hoop with said opposed track grooves being axially offset from said tubular track support frame and oriented radially outward and radially inward, respectively of the hoop.

24. A golf swing training apparatus of the circular track type for conditioning muscle memory in proper swing technique comprising the improvements of:

a circular hoop providing a club swing guide track;

a multi-wheeled cart mounted to ride on said hoop and be guided by said hoop track in a swing plane parallel to said hoop;

a golf club having a head and grippable handle at opposed ends of a club shaft;

a club-to-cart attachment having a rotatable and slidable bearing cooperating with said shaft intermediate said head and handle, and a pivot connecting said bearing to said cart so that said club rotates about its axis in said bearing, slides lengthwise along its axis in said bearing, and pivots at a moving point along said shaft in a plane orthogonal to that of said hoop; and a base mounting said hoop with its plane inclined upwardly, whereby a user stands inside said hoop and swings the club in a backswing, power stroke and followthrough guided by the cart riding on the hoop.

25. The golf swing training apparatus of claim 24 wherein said multi-wheeled cart comprises a set of at least three wheels, at least one of which has an outer circumference that engages said guide track.

26. The golf swing training apparatus of claim 24, wherein said club shaft has a slidably reciprocating portion of uniform diameter for slidable and rotatable cooperation with said bearing.

27. The golf swing training apparatus of claim 26, wherein said bearing of said club-to-cart attachment comprises an elongated linear bearing unit having a plurality of ball bearings that circulate in oblong retaining channels disposed lengthwise of said bearing unit to contact and minimize friction to both lengthwise sliding and axial rotation of the club shaft therewithin.

28. The golf swing training apparatus of claim 24, wherein said pivot of said club-to-cart attachment comprises first and second degrees of free rotation between said bearing and said multi-wheeled cart, a first degree of freedom being rotation of said bearing in a plane parallel to that of said hoop, and a second degree of freedom being pivotal movement of said bearing in a plane that passes generally through the diameter of said hoop and extends orthogonally to the plane of said hoop, whereby said club shaft is permitted to pivot in said orthogonal plane and rotate in a plane parallel to the hoop as the golf club swing is guided by the cart around the hoop circumference from backswing to power stroke and followthrough.

29. The golf swing training apparatus of claim 24, wherein said club-to-cart attachment further comprises an end-of-stroke cushioning spring mechanism disposed between said club head and said bearing for cushioning inertial impact between said bearing and club head during the backswing and followthrough portions of the training swing.

30. The golf swing training apparatus of claim 24, wherein said mounting frame comprises a base that is adapted to rest on a horizontal support surface and further comprising an adjustable front ladder assembly for adjusting the height of a lower front segment of said hoop and a plurality of rear telescoping struts extending between said base and said hoop for adjusting the incline of the plane of said hoop.

31. The golf swing training apparatus of claim 30, wherein said adjustable front ladder assembly comprises a horizontally disposed support bar having midlength structure connected to a lower forward segment of said hoop and having ends that extend laterally of said hoop being held in a plurality of vertically indexed height-adjusting notches formed in a frame structure that is supportedly connected to said base at laterally opposed front corners of said base.

* * * * *